US005312106A

United States Patent [19]

Cook

[11] Patent Number: 5,312,106

[45] Date of Patent: May 17, 1994

[54] COMPOSITE WEIGHTED GOLF CLUB HEADS

[76] Inventor: Don R. Cook, 9623 Earhart, South Lyon, Mich. 48178

[21] Appl. No.: 960,917

[22] Filed: Oct. 14, 1992

[51] Int. Cl.[5] ..... A63B 53/08

[52] U.S. Cl. ..... 273/169; 273/171; 273/173

[58] Field of Search ..... 273/78, 169-173, 273/167 A-167 K, 77 A

[56] References Cited

U.S. PATENT DOCUMENTS

| | | | |
|---|---|---|---|
| 2,654,608 | 10/1953 | Liebers | 273/169 |
| 3,866,792 | 2/1975 | Minke | 220/72 |
| 3,955,820 | 5/1976 | Cochran et al. | 273/167 |
| 3,961,796 | 6/1976 | Thompson | 273/167 |
| 3,995,865 | 12/1976 | Cochran et al. | 273/169 |
| 4,145,052 | 3/1979 | Janssen et al. | 273/171 |
| 4,582,321 | 4/1986 | Yoneyama | 273/78 |
| 4,607,846 | 8/1986 | Perkins | 273/171 |
| 4,630,826 | 12/1986 | Nishigaki | 273/167 |
| 4,664,383 | 5/1987 | Aizawa | 273/78 |
| 4,667,963 | 5/1987 | Yoneyama | 273/78 |
| 4,699,383 | 10/1987 | Kobayashi | 273/169 |
| 4,730,830 | 3/1988 | Tilley | 273/171 |
| 4,852,880 | 8/1989 | Kobayashi | 273/169 |
| 4,883,274 | 11/1989 | Hsien | 273/171 |
| 4,884,812 | 12/1989 | Nagasaki et al. | 273/169 |
| 4,964,640 | 10/1990 | Nakanishi et al. | 273/171 |
| 5,000,454 | 3/1991 | Soda | 273/167 |
| 5,004,242 | 4/1991 | Iwanaga et al. | 273/169 |
| 5,009,425 | 4/1991 | Okumoto et al. | 273/167 |
| 5,013,041 | 5/1991 | Sun et al. | 273/164 |
| 5,056,788 | 10/1991 | Katayama | 273/167 F |

*Primary Examiner*—Vincent Millin
*Assistant Examiner*—Steven B. Wong
*Attorney, Agent, or Firm*—James M. Deimen

[57] ABSTRACT

A set of golf club heads, each comprising a metal body and hosel and a resin composite striking face with oriented reinforcing fibers. In the resin composite, glass fibers are oriented horizontally and graphite fibers are oriented perpendicular to the glass fibers. Within each club head is formed a borehole parallel to the striking face and parallel to the ground at the instant the club head strikes a ball. The borehole is partially filled with tungsten powder. Resin plugs in the borehole retain and locate a measured quantity of tungsten powder to balance the golf club and create a "sweet line" for ideal striking of the ball. Thus, within the set of club heads the angle of the borehole relative to the bottom of the club head increases with increasing club number as does the transverse angle of the borehole to the centerline of the hosel.

5 Claims, 2 Drawing Sheets

COMPOSITE WEIGHTED GOLF CLUB HEADS

BACKGROUND OF THE INVENTION

The field of the invention pertains to golf clubs for the game of golf, and in particular to weighted golf club heads.

In recent years golf clubs have been constructed with a variety of new materials and structures as distinguished from the original irons and woods. The new materials and constructions are disclosed in several patents illustrating a variety of material combinations and design features. U.S. Pat. No. 4,699,383 discloses a fiber reinforced resin iron having a metal rib and sole plate. A metal plate back member is separate from the sole plate and disposed in the molding process to adjust the center of gravity of the club head. U.S. Pat. No. 4,582,321 discloses a carbon fiber reinforced resin iron having a core of iron or stainless steel. The core is formed with one or more through holes for the fiber reinforced resin to provide a "sweet spot" and to bind the front and back portions of the reinforced resin together.

U.S. Pat. No. 5,000,454 discloses a wood of fiber reinforced resin having a weight member of metal extending between the back and face plate of the club. The position of the weight member may be varied within the internal cavity of the club to adjust the center of gravity for weight and balance. A wood having a cylindrical weight therein generally extending from front to back is disclosed in U.S. Pat. No. 2,654,608 and in U.S. Pat. No. 4,730,830 an array of front to back boreholes are provided in a wood. Weights of different lengths are positioned in the boreholes to determine the weight and balance of the club head.

In U.S. Pat. No. 5,013,041 a pair of boreholes parallel to the club head face are disclosed. Weights may be selectively inserted in the boreholes to modify the center of gravity of the club head both horizontally and vertically. U.S. Pat. No. 3,961,796 discloses an iron having a single horizontal borehole parallel to the face. The club head is of stainless steel with a hollow back. Within the borehole is an aluminum plug for coarse weight adjustment and tungsten powder for fine weight adjustment. Disclosed in U.S. Pat. No. 5,009,425 is a club head having a core formed of powdered tungsten dispersed in a resin matrix. The shape of the molded core determines the location of the center of gravity of the club head.

In U.S. Pat. No. 3,955,820 a steel club head having tungsten weights embedded in the back of the club head is disclosed. The tungsten weights adjust the center of gravity of the club head and provide a relatively high radius of gyration for the golf club. U.S. Pat. No. 4,630,826 discloses a wood having a cavity therein surrounded by a layered block that also forms the face. The layered block is formed of alternating layers of ceramic and resin impregnated carbon or glass fibers. A club head having a dimpled metal core is disclosed in U.S. Pat. No. 4,664,383. The core is wrapped with a non-oriented fiber layer followed by a woven fiber layer, both layers being resin impregnated.

U.S. Pat. No. 4,852,880 discloses a balancing weight press fitted permanently into the back of the club head to modify the location of the center of gravity and "sweet spot" of the club. Disclosed are various means of assuring that the balancing weight cannot come loose when the club is swung. In U.S. Pat. No. 3,866,792 a reinforced filament wound structure comprising multiple layers of resin impregnated high strength fibers such as Kevlar, boron and graphite is disclosed.

Thus, from the foregoing it is clear that a wide variety of constructions with recently developed materials can be applied to golf club heads.

SUMMARY OF THE INVENTION

The new club head comprises a stainless steel frame in the form of a surrounding ring or solid body. The striking face of the club-head is formed with resin impregnated fibers wherein the fibers are specifically oriented and of two different materials, glass and graphite. The glass fibers are oriented horizontally and the graphite fibers are oriented perpendicular to the glass fibers. The striking face preferably comprises a high pressure molded insert affixed in a shallow cavity formed in the frame.

Formed in the club head is a borehole parallel to the striking face for the insertion of tungsten powder. The borehole extends from the hosel end of the face to the toe of the club head. Epoxy plugs within the borehole delimit the location and quantity of tungsten powder placed in the borehole.

Regardless of the number of the club, the vertical distance of the borehole above ground at the toe remains the same. Thus, the angle of the borehole relative to the bottom of the club and the diagonal height of the borehole at the toe increase with increasing club number. The "sweet spot" on each club becomes a "sweet line" on the face of the club above and forward of the borehole, and the position of the sweet line rotates upwardly beneath the face with increasing club number to remain substantially horizontal to the ground at the instant the ball is struck by the club.

DESCRIPTION OF THE PREFERRED EMBODIMENTS

Figure 1A:
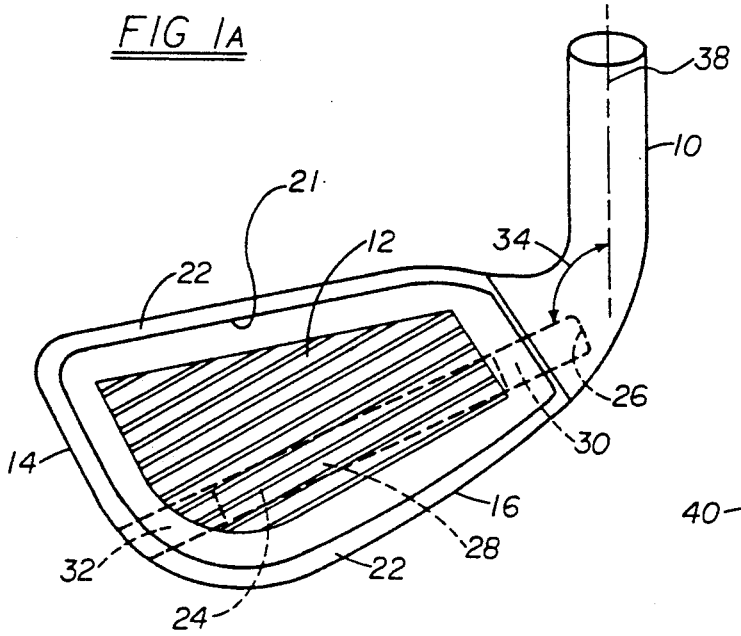
FIG. 1A is a striking face view of the new golf club head as a #3 iron.
Figure 1B:
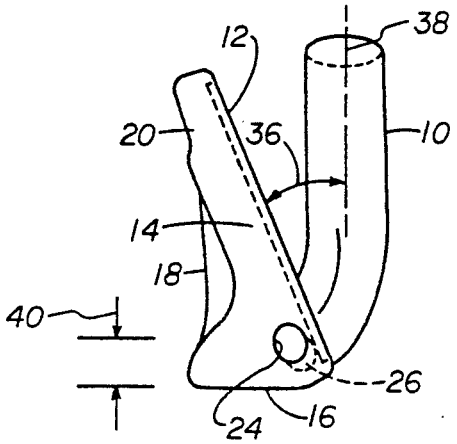
FIG. 1B is a toe view of the new golf club head of FIG. 1A.
Figure 1C:
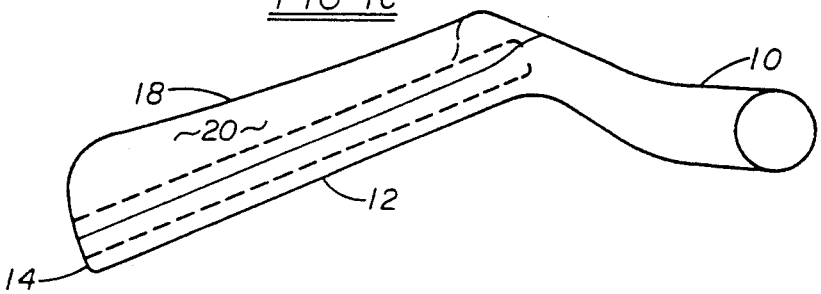
FIG. 1C is a top view of the new golf club head of FIG. 1A.

In FIGS. 1A, 1B, and 1C, the club head for a #3 iron comprises a hosel 10, striking face 12, toe 14, bottom 16 and back 18. As best shown in FIG. 1B, the face 12 is tilted back relative to the hosel 10 and the degree of tilt is related to the number of the club. The face 12 of the club head comprises a fiber reinforced resin composite inset into the stainless steel body 20 and bordered by stainless steel 22 about the top, toe and bottom edges of the striking face.

The club head body 20 is cast or forged from stainless steel with a shallow depression or cavity 21 about 2 millimeters deep formed in the face portion of the body 20 to accept the fiber reinforced resin face 12. The resin face 12 comprises glass fibers substantially oriented horizontally and graphite fibers substantially oriented vertically in an epoxy or polyester resin compressed and cured at up to 150,000 pounds per square inch. The cured face 12 is attached into the shallow depression 21 with epoxy cement. This construction provides an elastic quality that maintains extended contact with the ball on follow through.

The club head body 20 includes a borehole 24 formed therein as shown in dotted outline. The borehole 20 extends from the toe 14 to a blind end 26 beyond the face 12 and toward the hosel 10. The borehole 24 provides an internal chamber for the insertion of tungsten powder 28 to weight and balance the golf club. The amount and placement of tungsten powder 28 is determined by the length of epoxy plugs 30 and 32 inserted before and after the powder respectively. As indicated by the arrows 34 or 36, there exists an angular relationship between the centerline 38 of the hosel and either the borehole 24 or the face 12 of the club head respectively.

Figure 2A:
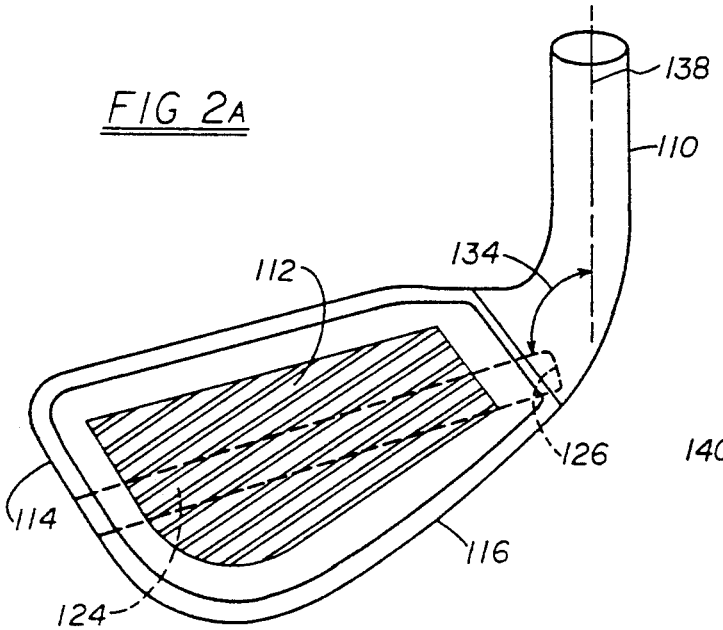
FIG. 2A is a face view of the new golf club head as a #5 iron.
Figure 2B:
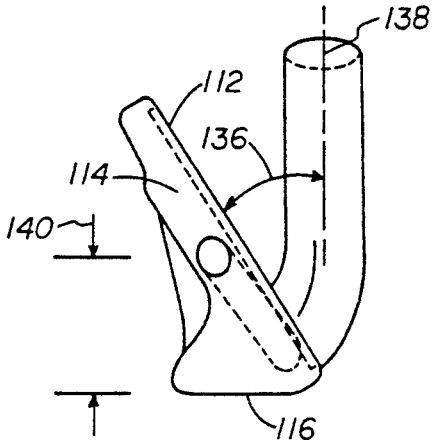
FIG. 2B is a toe view of the new golf club head of FIG. 2A.

In FIGS. 2A and 2B, a #5 iron club head is illustrated. The construction is substantially similar to the club head in FIGS. 1A, 1B and 1C; however, the angular relationship of the hosel 110 to the face 112 is distinctively changed. As best shown in FIG. 2B, the face 112 is tilted back considerably more relative to the hosel 110 and the borehole 124 moved diagonally upward beneath the face 112. As above, the borehole 124 extends from the hosel area 126 to the toe 114. As seen face on in FIG. 2A, the borehole 124 moves diagonally upward relative to the bottom 116 of the club head. As seen from the toe end 114 in FIG. 2B, the opening of the borehole 124 is considerably higher 140 above the club head bottom 116 than the corresponding opening of the borehole 24 above 40 the bottom 16 of the #3 iron in FIG. 1. The change of angle 36 for the #3 iron to the larger angle 136 for the #5 iron requires the change in position of the borehole 24 to the position of borehole 124. However, angle 34 between the hosel centerline 38 and borehole 24 is not substantially different from angle 134 between hosel centerline 138 and borehole 124. When a ball is struck, borehole 24 or borehole 124 is substantially parallel to the ground at an elevation approximate for striking the ball on the face adjacent the borehole. In effect, the boreholes 24 and 124 form a "sweet line" on the club faces for striking the ball.

Figure 3A:
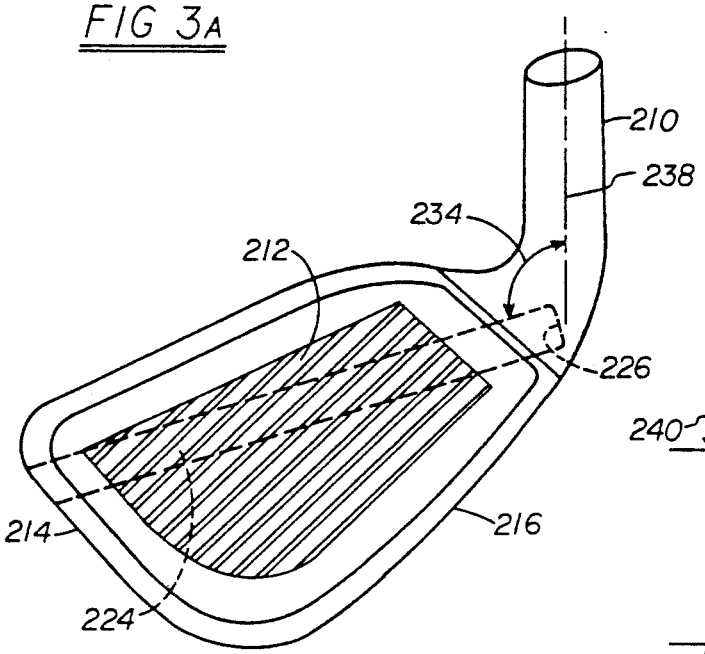
FIG. 3A is a face view of the new golf club head as a #9 iron.
Figure 3B:
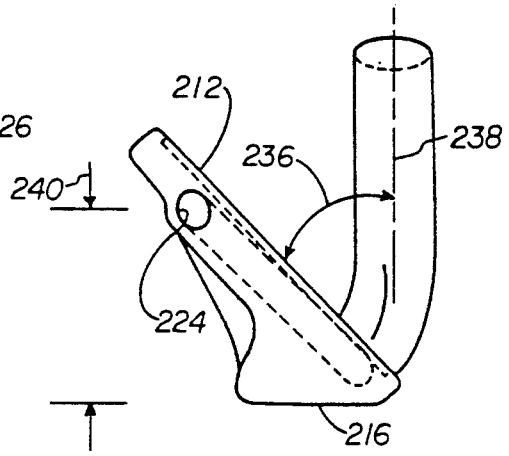
FIG. 3B is a toe view of the new golf club head of FIG. 3A.

Further illustrating the change in position of the borehole is the borehole 224 illustrated with respect to a #9 iron in FIGS. 3A and 3B. The angle 236 between the hosel centerline 238 and the face 212 is further increased; however, angle 234 remains substantially unchanged. The height 240 of the borehole 224 opening at the toe 214 relative to the bottom 216 is further substantially increased as shown in FIG. 3B. The "sweet line" formed by the tungsten filled borehole 224 again is parallel to the ground as the ball is struck. In summary, with increasing club number, the borehole "rotates" upwardly under the club face to always provide a "sweet line" parallel to the ground at the striking position.

Figure 4A:
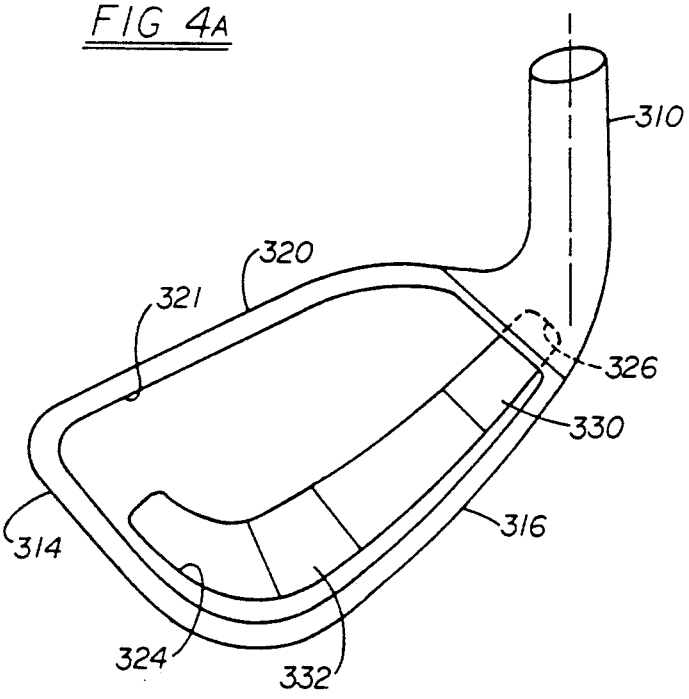
FIG. 4A is a face view of an alternative form of the new golf club head as a #9 iron.
Figure 4B:
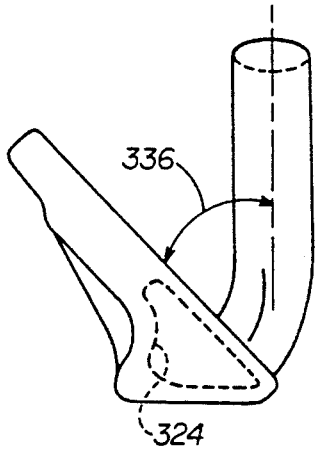
FIG. 4B is a toe view of the alternative form of the new golf club head of FIG. 4A.

FIGS. 4A and 4B illustrate an alternative form of the golf club head wherein the metal body 320 includes an L-shaped depression 324 extending further into the body from the shallow cavity 321 that contains the composite face 312. The L-shaped depression replaces the borehole of FIGS. 1, 2 and 3. Epoxy plugs 330 and 332 are placed in the L-shaped depression 324 to position the tungsten powder. After the tungsten powder is added to the depression 324 more epoxy is added to the shallow cavity 321 and the composite face 312 positioned in the cavity. Epoxy is thereby forced into the tungsten powder creating a hard mass.

The L-shaped depression 324 is larger than the above boreholes allowing more freedom to adjust the balance of the golf club and keep the "sweet line" parallel to the ground at the moment of ball impact with the club. Adjusting the amount of tungsten powder at the toe 314 allows for the same effect as moving the borehole in the set of clubs with increasing number of the iron.

In the alternative form of FIG. 4 the metal body 320 is formed of titanium in substitution for stainless steel. The plugs 330 and 332 may be preformed or applied as a soft plastic gel into the depression 324 prior to adding the tungsten powder.

I claim:

1. A golf club head comprising a metal hosel and metal body, a toe end on the body and spaced from the hosel, a striking face on the club head, said striking face substantially formed of a molded fiber reinforced resin adhered to the metal body, an L-shaped depression having a short end and a long end, the L-shaped depression formed in the metal body and extending beneath the striking face with the short end of the L at the toe end of the striking face, selectable weighting means placed in the depression to balance the club head and form a "sweet line" along the striking face of the club head, said weighting means positioned by plugs in the depression.

2. The golf club head of claim 1 wherein the selectable weighting means comprises tungsten powder packed in the depression, the depression being sealed by the striking face.

3. The golf club head of claim 1 wherein the metal body is formed with a shallow cavity for receiving the fiber reinforced resin striking face, the L-shaped depression extending from the shallow cavity.

4. The golf club head of claim 1 wherein the fiber reinforced resin includes fibers of at least two dissimilar materials oriented in differing directions relative to the striking face and metal body.

5. The golf club head of claim 4 wherein the fibers of two dissimilar materials comprise glass fibers oriented horizontally in the face of the club head and graphite fibers oriented perpendicular to the glass fibers in the face of the club head.

* * * * *